US006006761A

United States Patent [19]

Meledandri

[11] Patent Number: 6,006,761

[45] Date of Patent: Dec. 28, 1999

[54] TWO-SIDED PREPARATION AND FINISHING APPLICATOR

[75] Inventor: Catherine A. Meledandri, Breinigsville, Pa.

[73] Assignee: Victoria Vogue, Inc., Bethlehem, Pa.

[21] Appl. No.: 09/288,196

[22] Filed: Apr. 8, 1999

[51] Int. Cl.[6] ..... A45D 40/26

[52] U.S. Cl. ..... 132/320; 132/317; 401/200; 401/37; 401/38; 15/118; 15/104.93; 15/209.1; 15/229.14

[58] Field of Search ..... 132/320, 293, 132/298, 308, 306, 307, 312, 317; 401/20, 200, 37, 38; 15/118, 104.93, 209.1, 229.14, 208

[56] References Cited

U.S. PATENT DOCUMENTS

| | | | |
|---|---|---|---|
| 1,357,412 | 11/1920 | Mosheim . | |
| 1,836,833 | 12/1931 | Ames | 132/320 |
| 2,382,169 | 8/1945 | Pena | 15/229.14 |
| 3,857,133 | 12/1974 | Linenfelser . | |
| 4,027,350 | 6/1977 | Kotche | 15/104.93 |
| 4,510,641 | 4/1985 | Morris | 15/118 |
| 4,698,871 | 10/1987 | Patkos . | |
| 5,639,532 | 6/1997 | Wells | 15/209.1 |

FOREIGN PATENT DOCUMENTS

| | | | |
|---|---|---|---|
| 441667 | 8/1991 | European Pat. Off. | 132/320 |

*Primary Examiner*—Gene Mancene
*Assistant Examiner*—Pedro Philogene
*Attorney, Agent, or Firm*—James & Franklin, LLP; Robert L. Epstein; Harold James

[57] ABSTRACT

The applicator includes an exterior layer of liquid retaining material, an interior layer of liquid barrier material, an interior layer of filler material and an exterior layer of powder retaining material. The liquid barrier layer is interposed between the liquid retaining layer and the filler layer. The layer of powder retaining material has a peripheral edge section which extends around the end of the filler material layer to a position beneath the liquid barrier layer with its exterior surface facing the interior surface of the liquid retaining layer.

42 Claims, 2 Drawing Sheets

TWO-SIDED PREPARATION AND FINISHING APPLICATOR

CROSS-REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to applicators and more particularly to a two-sided applicator suitable for use with both "wet" and "dry" products.

Cosmetic, pharmaceutical and other types of skin preparations are commercially available in "wet" or liquid compositions in a variety of different viscosities. As used herein, the term "liquid" should be considered in its broadest sense, to include any non-gaseous fluid such as creams, ointments, lotions, gels, pastes, foams, semi-liquids and semi-solids. Applicators made of foam, sponge, flock materials and the like are used to apply these compositions. Other preparations are sold "dry" in the form of powders of various particle sizes. As used herein, the term "powder" should be considered in its broadest sense, to include any substance formed of fine, dust-like particles. Applicators in the form of brushes, puffs, fabric pads and the like are known for applying these "dry" products.

For example, foundation make-up is commonly supplied in powder or dry form. Within this category, the powder has particles of different sizes. These are known as "finishing" powder, "loose" powder or "pressed" powder. Foundation make-up is also sold in liquid or wet form. The needs of the wearer will dictate which form, liquid or powder, is employed at a particular time. Sometimes, if a liquid foundation is required but not available or simply to avoid carrying both liquid and powder foundations, a powder foundation is mixed with water to form a liquid. The viscosity of the liquid depends upon the proportions of water to powder.

Powder foundation products are supplied with applicators, such as puffs or brushes, which are suitable for use only with dry preparations. If the powder is mixed with water to create a liquid, in most cases a different applicator is required. Accordingly, if the foundation product is to be used in both the wet and the dry form, two separate applicators are usually required, one suitable for use with wet preparations and one suitable for dry preparations. The present invention avoids this problem by incorporating an applicator suitable for wet preparations and an applicator suitable for dry preparations in a single two-sided applicator which is washable and reuseable.

In general, this object is achieved by employing a two sided structure with an internal liquid barrier. One side is composed of a liquid retaining exterior layer suitable for applying wet formulations of a wide variety of different viscosities. The other side is composed of a powder retaining exterior layer suitable for applying dry preparations with a wide range of different particle sizes. A filler layer is situated between the layers to give the applicator the appropriate body, resiliency and density. A liquid impervious barrier layer is interposed between the liquid retaining layer and the filler layer to prevent the liquid from migrating into the filler layer or the powder retaining layer.

Preferrably, the barrier layer is a heat actuatable adhesive in the form of a polymer film which is coated on the interior surface of the liquid retaining layer. The layers are assembled, heat applied, and the edges pinched and rolled to form a two-sided applicator.

2. Description of Related Art Including Information Disclosed Under 37 CFR 1.97 and 1.98

I am aware of powder puffs which are designed to be used on both sides, such as disclosed in the patent to A. S. Mosheim, U.S. Pat. No. 1,357,412 of Nov. 2, 1920, where the sides are joined back to back by rubber or other adhesive material. However, the Mosheim puff is made of the same material on both sides and is not suitable for wet applications.

I am also aware of a facial pad disclosed in U.S. Pat. No. 4,698,871 issued to I. Patkos on Oct. 13, 1987 which is designed for two sided use. The Patkos pad includes a pile fabric, such as cotton velour, covering one side of the filler material. The other side of the filler has an optional fabric layer, covered by a mesh material. The pad is used to remove caked facial powder from a compact and for applying the powder to the skin. The mesh material is employed for abrading and loosening the surface of the powder. The pile fabric side is used for applying the loosened powder to the face. This structure is likewise unsuitable for use with anything but a powder preparation.

It is, therefore, a prime object of the present invention to provide a two-sided applicator suitable for use with both wet and dry preparation and finishing products.

It is another object of the present invention to provide a two-sided applicator which includes a liquid barrier layer to prevent migration of liquid to the filler layer or the powder retaining layer.

It is another object of the present invention to provide a two-sided applicator in which the barrier layer is a heat actuated adhesive coating which both seals and bonds the layers.

BRIEF DESCRIPTION OF THE INVENTION

In accordance with the present invention, a two-sided applicator is provided. The applicator includes an exterior layer of liquid retaining material, an interior layer of liquid barrier material, an interior layer of filler material and an exterior layer of powder retaining material. The liquid barrier layer is interposed between the liquid retaining layer and the filler layer.

Preferrably, the liquid barrier layer is a coating of adhesive applied to the interior surface of the liquid retaining layer. Most preferrably, the adhesive coating is heat actuated so as to act as a bonding agent for joining the layers during assembly, as heat is applied.

Preferrably, the liquid retaining layer comprises a foam layer, most preferrably a reticulated urethane foam. However, closed cell, non-reticulated, clickable, non-clickable, Rubycell foam, with a pore size in the range of 50 to 500 pores per inch, are also suitable. Rubycell is a material available from Toyo Polymer Co. Ltd., Osaka, Japan. Further, flocked materials including nylon, rayon, polyester, acrylics and cotton or a blend of same could be employed for this layer. Other suitable materials include closed cell polyester, polyether, PVC (polyvinylchloride) PVA (polyvinyl-alcohol), SBR (styrene butadiene rubber), NBR (acrylnitrile butadiene rubber), Yukilon, closed cell rubber, natural rubber Polyolefin, EPDM (Ethylene, Propylene, Diene, Monomer) , mesh coated in polyurethane, cellulose, SBR, NBR, natural rubber or any combination thereof. Yukilon is a material available from Yukigaya Chemical Industries Co., Ltd., Tokyo, Japan. This layer preferrably has a thickness in the range of 0.5 mm to 15.0 mm.

The liquid barrier can be made of a coating, laminate or separate layer of polyethelene, polyurethane or polypropolene, natural or synthetic Latex, EPDM, rubber, styrene, nylon, coated paper, foil, Polyolefin, plastics made of nylon or polyester, or Teflon, PVA or PVC. The thickness of the barrier layer can vary from 0.02 mm to 6.0 mm.

The filler layer is preferrably composed of "needle punch", which is a non-woven fabric which has been punched by a needle to create a plurality of small openings which bond the fibers together. The fabric can be polyester or a blend thereof or poly-cotton. Other suitable materials include polyurethane foam, either reticulated or non-reticulated, either in closed or open cell form, or rubber. This layer preferrably has a thickness in the range of 0.5 mm to 15.0 mm.

The powder retaining layer is preferrably composed of woven cotton velour. Other suitable materials include woven nylon, acrylic, wool, felt or polyester pile fabric, flannel, woven cotton cloth, woven blends of rayon, wool, polyester, cotton and nylon, and knitted fabrics of cotton, rayon, polyester, acrylic, nylon, felt, flannel or blends thereof. This layer preferrably has a thickness in the range of 0.5 mm to 50.0 mm.

BRIEF DESCRIPTION OF THE SEVERAL VIEWS OF THE DRAWINGS

To these and to such other objects which may hereinafter appear, the present invention relates to a two sided preparation and finishing applicator, as described in detail in the following specification and recited in the annexed claims, taken together with the accompanying drawings, in which like numbers refer to like parts, and in which:

DETAILED DESCRIPTION OF THE INVENTION

Figure 1:
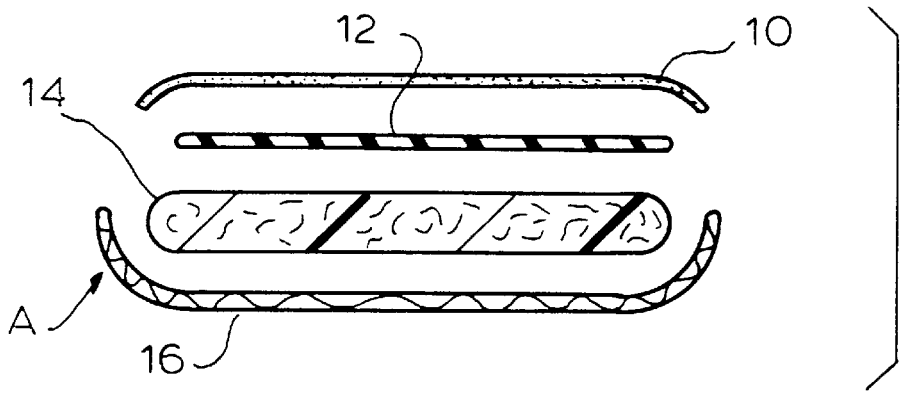
FIG. 1 is an exploded view of the applicator in its first preferred form.

As seen in the drawings, the applicator of the present invention has a two-sided structure. One side is suitable for applying wet preparations. The other side is suitable for applying dry preparations. A liquid barrier is provided internally to prevent liquid from migrating from the wet side of the applicator to the dry side of the applicator.

The applicator, generally designated A, can be any shape or size desired. For purposes of illustration, a round applicator with a 2" to 3" diameter is depicted in the drawings as is commonly used in compacts. However, the applicator could be square, rectangular or any other geometric shape and larger or smaller, as needed. Applicator A includes four layers. The first exterior layer 10 is a liquid retaining layer which forms the wet side of the applicator. Adjacent liquid retaining layer 10 is the interior liquid barrier layer 12. Situated on the other side of barrier layer 12 is an interior filler layer 14. A powder retaining layer 16 is the external layer forming the dry side of the applicator.

Layer 10 is formed of a material which will retain a liquid and provide a means for transferring the liquid from a reservoir to the skin. It can be composed of a foam, flocked or rubber type material. It preferrably has a thickness in the range from 0.5 mm to 15.0 mm.

Most preferrably, layer 10 is composed of a reticulated urethane foam. However, closed cell, non-reticulated, clickable, non-clickable and Rubycell foams, with pore sizes in the range of from 50 to 500 pores per inch, could also be used. Flocked materials including nylon, rayon, polyester, acrylics and cotton or blends thereof are suitable. Other suitable materials such as closed cell polyester, polyether, PVC, PVA, SBR (styrene butadiene rubber), NBR (acylnitrite butadiene rubber), Yukilon, preferrably of a density of 1–50 pounds per cubic foot, closed cell rubber or natural rubber could be used. Polyolefin, EPDM (Ethylene, Propylene, Diene, Monomer), mesh coated in polyurethane, cellulose SBR, NBR, natural rubber or any combination thereof could also be used.

Barrier layer 12 can be a coating, laminate or separate film or foil layer of polyethylene, polyurethene, polypropylene, natural or synthetic Latex, Polyolefin, rubber, EPDM, styrene, nylon, coated paper, teflon, PVC, PVA or plastic composed of nylon or polyester which are flexible, liquid impermeable and resistant to various formulations, alcohol and oil. The barrier layer preferrably has a thickness of between 0.02 mm to 6.0 mm.

Figure 2:
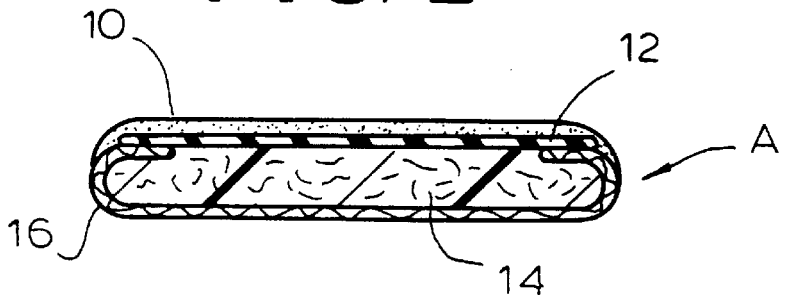
FIG. 2 is a cross-sectional view of the applicator of FIG. 1.
Figure 3:
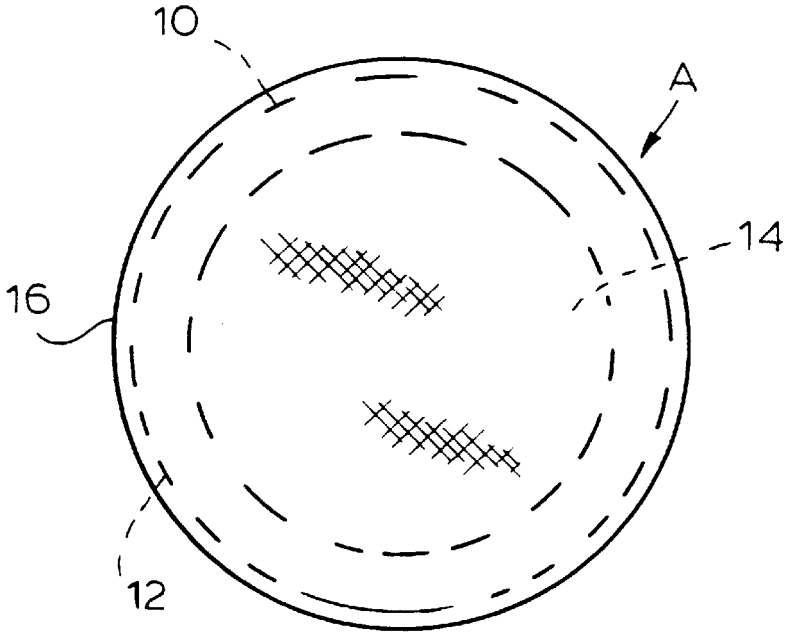
FIG. 3 is an elevational view of the applicator of FIG. 1.
Figure 4:
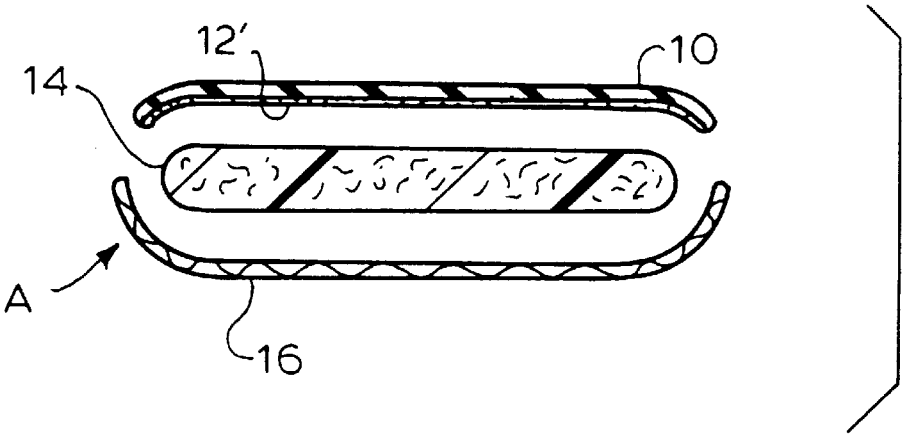
FIG. 4 is an exploded view of the applicator in its most preferred form.
Figure 5:
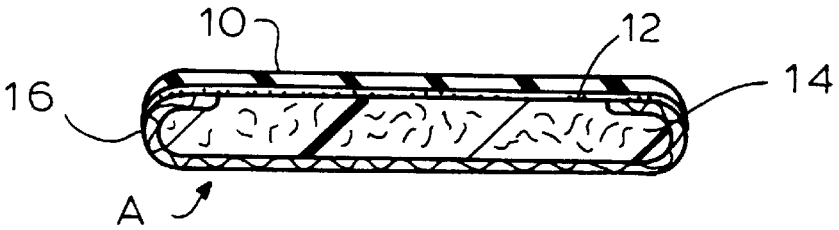
FIG. 5 is a cross-sectional view of the applicator of FIG. 4.
Figure 6:
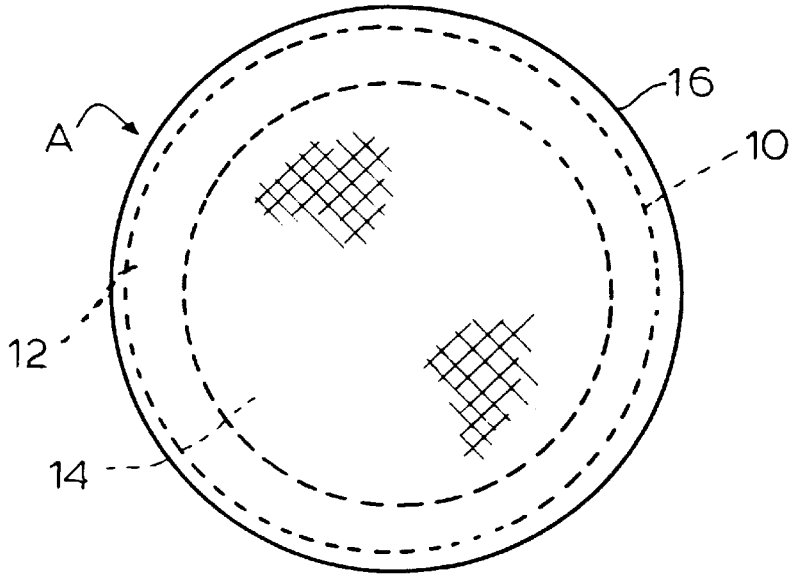
FIG. 6 is an elevational view of the applicator of FIG. 4.

Layer 12 is shown as a separate layer in FIGS. 1–3 and as a coating or laminate 12' in FIGS. 4–6. Layer 12' is preferrably a heat actuated adhesive which melts when heated to form a glue which both seals and bonds the layers. One example of such a product is a water based polymer film available from Lloyd & McKenzie Ltd. Co. of Chester South Carolina and is known commercially as LC23 heat-seal coating. However, other products with similar sealing and bonding qualities may be used as well.

The filler layer 14 is composed of a material which has suitable thickness, loft, resilience, flexibility and density to provide for comfortable skin application. The preferred material is needle punch, which is a non-woven fabric made of polyester, polyester blends or poly-cotton which is "punched" with needles to create openings and to bond the fibers together. However, polyester or polyether foam, reticulated or non-reticulated, in either closed or open cell form could be employed, as could rubber. Layer 14 preferrably has a thickness 0.5 mm to 15.0 mm.

Powder retaining layer 16 is composed of a fabric capable of picking up and transferring various dry preparations, such as finishing, pressed powder or loose powder. Preferrably, it is made of a woven cotton velour, for example complosed of 100% cotton, with a 0.09 inch to 0.50 inch pile height, 10 oz/sq.yd–48 oz/sq.yd weight, with 30 picks/inch to 112 picks/inch. Also suitable for this purpose is a woven or knitted rayon, nylon or polyester with a 0.05 mm–15 mm pile height, various acrylics or acrylic blends such as 50/50% acrylic/ polyester, 100% modacrylic, 50/50% acylic/modacrylic, having ⅛ inch to 2 inches pile height and 10 oz/sq.yd–48 oz/sq.yd weight. Further, layer 16 could be compose of flannel, woven cotton cloth, woven blends of rayon, polyester, cotton and nylon, or knitted fabrics made of cotton, rayon, polyester, nylon or blends thereof may be used. Suitable thickness of layer 16 is in the range of 0.5 mm–50.0 mm.

The layers are assembled in the order illustrated to form a unitary two-sided applicator. As shown in FIGS. 1–3, the powder retaining layer 16 is formed to be larger than the other layers so that the edge thereof can be placed around filler layer 14 to finish the edge of the applicator. With the edge of layer 16 in place, tucked under layer 12, and the layers held together, the layers may be joined by any method, such as heat, pressure, sonic energy, RF energy, or sewing, with or without bonding agents and/or adhesives to create the fused, pinched or roller edge, two-side applicator, which is washable and reusable. Either or both of the exterior surfaces can be printed, blind embossed or labeled, as desired.

When a heat actuated adhesive barrier layer 12' is used, it is coated on the interior surface of liquid retaining layer 10, as illustrated in FIG. 4. The filler layer 14 and powder retaining layer 16 are joined to adhesive layer 12' (and thus layer 10) by first wrapping the extended edge of layer 16 around the edge of layer 14 and then holding the layers together while heat is applied to the assembly to actuate the adhesive coating to bond the layers, as seen in FIGS. 5 and 6.

The applicator could also be provided with a band of ribbon, leather or synthetic material to facilitate manipulation of the applicator. Alternatively, a stick, handle or holder could be affixed to the applicator.

It should now be appreciated that the present invention relates to a two-sided applicator formed of an external liquid retaining layer, a liquid barrier layer, a filler layer and an external powder retaining layer which are assembled to form a two-sided applicator suitable for applying either wet or dry preparations. The applicator is washable and reuseable.

While only a limited number of preferred embodiments of the present invention have been disclosed for purposes of illustration, it is obvious that many variations and modifications could be made thereto. It is intended to cover all of these variations and modifications which fall within the scope of the present invention, as defined by the following claims:

I claim:

1. An applicator comprising an exterior layer of liquid retaining material, an interior layer of liquid barrier material, an interior layer of filler material having an end and an exterior layer of powder retaining material, said liquid barrier material layer being interposed between said liquid retaining material layer and said filler material layer, one of said exterior layers comprising a peripheral edge section which extends around said end of the layer of filler material, from one side of said layer of filler material to the other side.

2. The applicator of claim 1 wherein said liquid retaining layer has an interior surface and wherein said liquid barrier layer comprises a coating on said interior surface of said liquid retaining layer.

3. The applicator of claim 2 wherein said coating comprises adhesive.

4. The applicator of claim 3 wherein said adhesive is heat actuated.

5. The applicator of claim 2 wherein said coating comprises a polymer film.

6. The applicator of claim 1 wherein said liquid retaining layer comprises a flocked material.

7. The applicator of claim 1 wherein said liquid retaining layer comprises foam.

8. The applicator of claim 1 wherein said liquid retaining layer comprises urethane foam.

9. The application claim 8 wherein said urethane foam is reticulated.

10. The applicator of claim 1 wherein said foam has a pore size in the range of 50 to 500 pores per inch.

11. The applicator of claim 1 wherein said liquid retaining layer comprises rubber.

12. The applicator of claim 1 wherein said liquid retaining layer comprises closed cell polyester.

13. The applicator of claim 1 wherein said liquid retaining layer has a thickness in the range of 0.5 mm–15.0 mm.

14. The applicator of claim 1 wherein said liquid barrier layer comprises polyethelene.

15. The application of claim 1 wherein said liquid barrier layer comprises polyurethane.

16. The application of claim 1 wherein said barrier layer comprises polypropylene.

17. The applicator of claim 1 wherein said liquid barrier layer comprises Latex.

18. The applicator of claim 1 wherein said liquid barrier layer comprises rubber.

19. The applicator of claim 1 wherein said liquid barrier layer comprises plastic.

20. The applicator of claim 1 wherein said liquid barrier layer comprises styrene.

21. The applicator of claim 1 wherein said liquid barrier layer comprises foil.

22. The applicator of claim 1 wherein said liquid barrier layer comprises Polyolefin.

23. The application of claim 1 wherein said liquid barrier layer has a thickness in the range of 0.02 mm to 6.0 mm.

24. The applicator of claim 1 wherein said filler layer comprises needle punch.

25. The applicator of claim 1 wherein said filler layer comprises fabric.

26. The applicator of claim 1 wherein said filler layer comprises polyester.

27. The applicator of claim 1 wherein said filler layer comprises foam.

28. The applicator of claim 1 wherein said filler layer comprises rubber.

29. The applicator of claim 1 wherein said filler layer has a thickness between 0.5 mm and 15.0 mm.

30. The applicator of claim 1 wherein said powder retaining layer comprises fabric.

31. The applicator of claim 30 wherein said fabric is woven.

32. The applicator of claim 30 wherein said fabric is knitted.

33. The applicator of claim 1 wherein said powder retaining layer comprises cotton.

34. The applicator of claim 1 wherein said powder retaining layer comprises rayon.

35. The applicator of claim 1 wherein said powder retaining layer comprises acrylic.

36. The applicator of claim 1 wherein said powder retaining layer comprises nylon.

37. The applicator of claim 1 wherein said powder retaining layer comprises polyester.

38. The applicator of claim 1 wherein said powder retaining layer comprises flannel.

39. The applicator of claim 1 wherein said powder retaining layer is woven cotton velour.

40. The applicator of claim 1 wherein said powder retaining layer has a thickness in the range of 0.5 mm–50.0 mm.

41. The applicator of claim 1 wherein said peripheral edge section extends to a position between said filler material layer and said liquid barrier material layer.

42. The applicator of claim 1 wherein said other of said exterior layers has an interior surface, said peripheral edge section has an exterior surface and wherein said interior surface and said exterior surface face each other.

* * * * *